US005542632A

United States Patent [19]

Long

[11] Patent Number: 5,542,632

[45] Date of Patent: Aug. 6, 1996

[54] MOUNTING ASSEMBLY FOR RADIANT HEATER

[75] Inventor: Norris R. Long, Wichita, Kans.

[73] Assignee: The Coleman Company, Wichita, Kans.

[21] Appl. No.: 412,419

[22] Filed: Mar. 28, 1995

[51] Int. Cl.[6] ..... A47B 96/06

[52] U.S. Cl. ..... 248/205.1; 126/92 B; 431/344

[58] Field of Search ..... 248/205.1, 220.21, 248/222.11, 225.21, 227.1, 229.1, 229.13, 229.15, 230.1, 231.51; 403/400, DIG. 9; 126/92 B, 50, 40; 431/344; 362/159

[56] References Cited

U.S. PATENT DOCUMENTS

| | | | |
|---|---|---|---|
| D. 288,473 | 2/1987 | Schmidt | D23/124 |
| 1,822,356 | 9/1931 | McCartney . | |
| 2,825,325 | 3/1958 | Ross . | |
| 3,229,680 | 1/1966 | Herbert et al. . | |
| 3,852,025 | 12/1974 | Placek | 129/92 B X |
| 3,941,116 | 3/1976 | Placek | 126/92 B |
| 3,975,140 | 8/1976 | Placek | 431/329 |
| 4,063,876 | 12/1977 | Schweiss | 431/344 X |
| 4,378,783 | 4/1983 | Hunter | 431/329 X |
| 4,569,329 | 2/1986 | Cherryholmes | 126/92 B |
| 4,624,241 | 11/1986 | Cherryholmes | 126/92 B |
| 4,782,814 | 11/1988 | Cherryholmes | 126/92 B |
| 5,158,067 | 10/1992 | Dutro et al. | 126/50 X |
| 5,336,084 | 8/1994 | Long | 431/354 |
| 5,353,694 | 11/1994 | Fins | 126/92 B X |
| 5,368,475 | 11/1994 | Suppiah | 431/268 |

OTHER PUBLICATIONS

Coleman catalog page for Focus Propane Heaters.
Owner's Manual for Infra-Red Tank Top Heater Model HD12B (May 1994).
Advertising Material for Reddy Heater Model HD12.
Advertising material for Reddy Heater Model HD12B.
Owner's Manual and Operating Instructions for Paulin Heater.
Advertising Material for Paulin Heater.
Advertising Material for Mr. Heater heater.
Installation and Operating Instructions for Mr. Heater heater.

*Primary Examiner*—Ramon O. Ramirez

[57] ABSTRACT

A mounting assembly for mounting a radiant heater on an LPG tank includes an elongated rigid support tube, a hook on the lower end of the support tube, and a generally U-shaped clamp is mounted on the tube for pivoting and transverse movement. The clamp includes a pair of legs which terminate in hooked ends and a cross piece which connects the legs. A stud is threadedly engaged with the cross piece and is engageable with the tube. When the stud is tightened against the tube, the hooked ends of the clamp legs pivot toward the hook on the bottom of the tube to clamp a collar of an LPG tank between the hook ends of the leg and the hook on the tube, and the tube moves transversely relative to the legs and is forced against the collar.

13 Claims, 1 Drawing Sheet

MOUNTING ASSEMBLY FOR RADIANT HEATER

BACKGROUND AND SUMMARY

This invention relates to radiant heaters which are fueled by liquefied petroleum gas (LPG). More particularly, the invention relates to an improved mounting assembly for mounting on an LPG tank.

Radiant heaters, sometimes called infrared heaters, which are powered by LPG such as propane, butane, isobutane and mixtures thereof are well known. For example, U.S. Pat. Nos. 4,782,814, 4,624,241, and 4,569,329 describe such radiant heaters. The heaters described in those patents are specifically designed for use with relatively small disposable LPG fuel tanks, which contains, for example, about 12 ounces of fuel.

Other radiant heaters are designed for use with larger refillable LPG tanks which can hold 20 pounds or more of fuel. Radiant heaters which are designed for use with refillable LPG tanks are generally mounted directly on the tank, for example, by connecting the fuel tube of the heater to the standard POL outlet valve of the tank. However, such a connection imposes stress on the valve connection at the tank.

The invention provides a mounting assembly which includes an elongated rigid support member which extends downwardly from the heater, a hook on the bottom of the support member for engaging the bottom of a collar on a refillable LPG tank, and a clamp pivotably mounted on the lower end of the support member. The clamp is generally U-shaped and includes a pair of legs which straddle the support member and which are pivotably and movably mounted on the support member. The end of each leg terminates in a hook which is engageable with the top of the collar on the tank. A bolt extends through a threaded opening in the base of the U-shaped clamp and is engageable with the support member. When the bolt is tightened against the support member, the legs of the clamping member pivot against the top of the collar to clamp the collar between the hooked ends of the legs and the hook on the support member. The legs also move linearly relative to the support member to allow the support member to be forced against the collar. The combination of the clamping force on the collar and the pressure of the support member against the collar provides a very secure and reliable mount.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
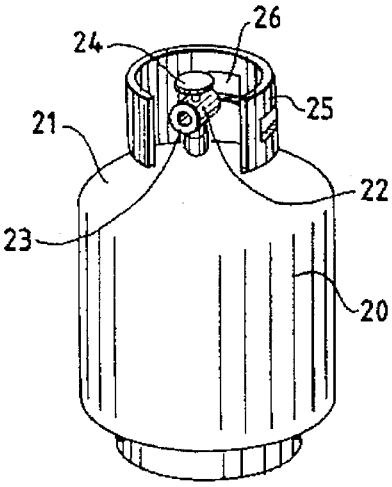
FIG. 1 is a perspective view of a conventional refillable LPG tank.

FIG. 1 illustrates a conventional refillable LPG tank 20 which is well known in the art. Such an LPG tank commonly holds up to about 30 pounds of fuel, although the invention can be used with smaller and larger tanks. The conventional LPG tank includes a generally dome-shaped top 21 and a POL outlet valve 22 which is screwed into the top of the tank. The POL valve includes an internally threaded connector 23 and a knob 24 for opening and closing the valve. The valve is protected by a generally cylindrical collar 25 which extends partway around the valve and which is provided with one or more openings 26 to facilitate carrying the tank.

Figure 2:
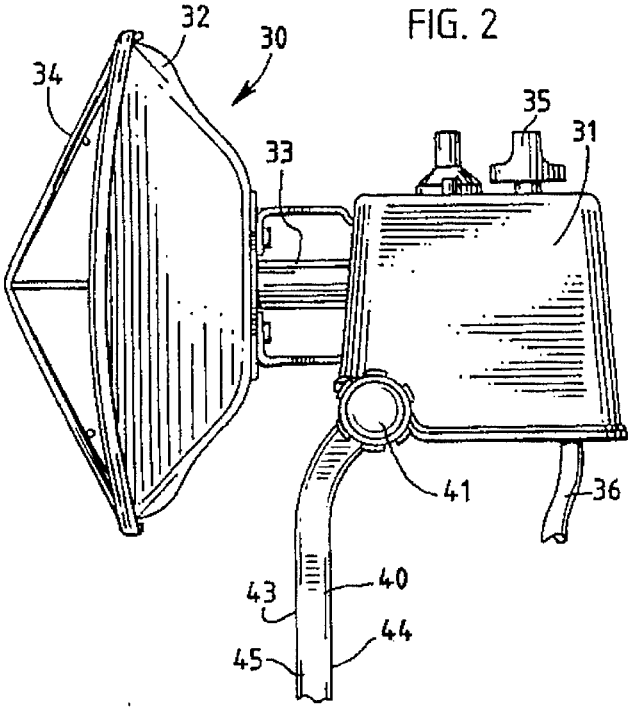
FIG. 2 is a fragmentary left side elevational view of a radiant heater which can be used with the mounting assembly of the invention.

Referring to FIG. 2, a radiant heater 30 includes a control housing 31, a reflector 32, and a burner tube 33 which extends between the housing 31 and the reflector 32. A protective wire guard 34 is mounted on the front of the reflector.

The radiant heater does not form part of this invention and the details of the radiant heater need not be described herein. The mounting assembly can be used with most conventional radiant heaters.

The housing 31 encloses a conventional fuel regulating valve which is operated by a control knob 35 above the housing. The regulating valve is connected to an LPG fuel tank by a flexible fuel hose 36 which terminates in a conventional externally threaded male coupler (not shown) which screws into the POL valve on the tank.

The radiant heater is mounted on an LPG tank by a rigid metal support tube 40 which is pivotally connected to the housing 31 by a bolt having a gripping knob 41. The bolt can be loosened and tightened by the knob so that the heater can be retained in a desired orientation. The tube 40 has a rectangular cross section and is slightly angled so that the heater is centered over the tank when the tube is clamped to the collar of the tank.

Figure 3:
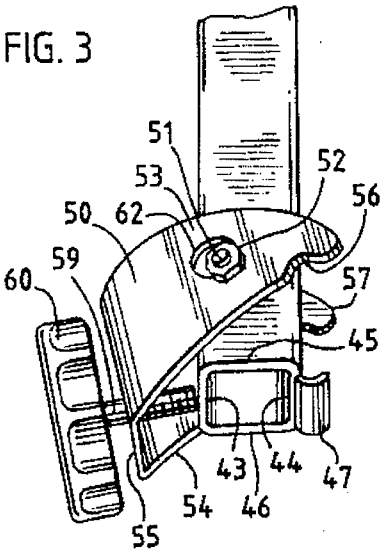
FIG. 3 is a fragmentary left side perspective view of the mounting assembly.
Figure 4:
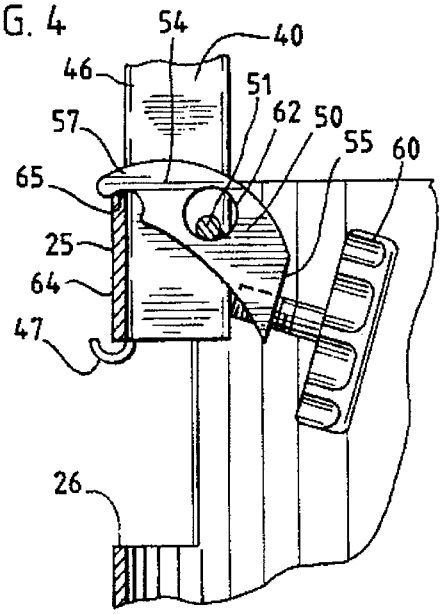
FIG. 4 is a fragmentary right side view, partially broken away, of the mounting assembly.

Referring to FIGS. 3 and 4, the rectangular tube 40 includes front and rear walls 43 and 44 and side walls 45 and 46. A hook 47 is welded or otherwise secured to the bottom of the rear wall 44. The hook is adapted to be inserted into one of the openings 26 in the collar 25 of an LPG tank as shown in FIG. 4 so that the hook engages an edge 48 of the collar which is formed by the opening 26.

A generally U-shaped clamp 50 is pivotably mounted on the tube 40 by a bolt 51 which extends through the side walls 45 and 46 of the tube. A nut 52 prevents the bolt from being withdrawn. The clamp includes a pair of flat legs 53 and 54 which straddle the tube 40 and a flat cross wall or base 55 which connects the legs. The ends of the legs terminate in hooks or notches 56 and 57.

A threaded stud or bolt 59 is threadedly engaged with an opening in the cross wall 55. A hand wheel or knob 60 is mounted on the outer end of the stud.

The legs 53 and 54 of the clamps are provided with openings 62 which may be circular or some other suitable shape which have inside dimensions significantly larger than the diameter of the bolt 51. The large openings permit dual movement of the clamp relative to the tube 40—a pivoting movement about the axis of the bolt 51, and transverse movement relative to the axis or a movement parallel to the side walls 45 and 46.

The mounting assembly is mounted on the collar 25 of the LPG tank by moving the rear wall 44 of the tube 40 against the outside surface of the collar and inserting the hook 47 through one of the openings 26 in the collar. The opening 26 creates a collar section 64 (FIG. 4) which has a bottom edge 48 and a top edge 65. The hooked ends 56 and 57 of the clamp are positioned over the top edge 65.

The dimension between the top and bottom edges 65 and 48 is greater than the vertical dimension between the bolt 51 and the hook 47, and the legs 53 and 54 of the clamp are angled upwardly from the cross wall 55. As the stud 59 is screwed inwardly against the front wall 43 of the tube 40, the legs 53 and 54 pivot relative to the bolt 51 to clamp the collar section 64 between the hooked ends of the legs and the hook 47 on the bottom of the tube 40. The large openings 62 in the legs also permit the tube 40 to be forced away from the cross wall 55 of the clamp against the outside surface of the collar section 64.

Tightening of the stud 59 therefore provides a double clamping action in which:

a) the hooks 56, 57 and hook 47 are clamped against the top and bottom edges of the collar section 64, and b) the rear wall 44 of the tube 40 is forced against the outside surface of the collar.

The double clamping action provides secure and reliable mounting forces which support the tube 40 and the heater in the desired orientation. The mounting assembly can be quickly clamped onto the collar by tightening the stud and can be quickly released from the collar by unscrewing the stud.

While in the foregoing specification a detailed description of specific embodiments of the invention were set forth for the purpose of illustration, it will be understood that many of the details herein given can be varied considerably by those skilled in the art without departing from the spirit and scope of the invention.

I claim:

1. A mounting assembly adapted for mounting a heater on an LPG tank which includes a top, an outlet valve mounted on the top, and a collar which extends around at least a portion of the outlet valve, the mounting assembly comprising an elongated rigid support member having an upper end for supporting a heater and a lower end, first hook means on the lower end of the support member for engaging an edge of a collar on an LPG tank, a generally U-shaped clamp pivotably mounted on the support member adjacent the lower end thereof, the clamp including a pair of legs which straddle the support member and a cross portion which connects the legs, the legs including second hook means for engaging an edge of a collar on an LPG tank, and means for pivoting the clamp relative to the support member for moving the second hook means toward the first hook means.

2. The mounting assembly of claim 1 in which the pivoting means comprises a stud which is threadedly engaged with the cross portion of the clamp, the stud being engageable with the support member as the stud is screwed into the cross portion.

3. The mounting assembly of claim 2 in which the support member is generally -rectangular in cross section and includes a front wall, a rear wall, and a pair of side walls, the first hook means being attached to the rear wall and the legs of the clamp straddling the side walls, the stud being engageable with the front wall.

4. The mounting assembly of claim 1 in which the clamp is mounted for movement transversely to the elongated support member.

5. The mounting assembly of claim 1 in which the clamp is pivotably mounted by a bolt which extends through the support member and through openings in the legs of the clamp.

6. The mounting assembly of claim 5 in which the openings in the legs are larger than the bolt so that the clamp can move transversely relative to the elongated support member.

7. The mounting assembly of claim 6 in which the pivoting means comprises a stud which is threadedly engaged with the cross portion of the clamp, the stud being engageable with the support member as the stud is screwed into the cross portion.

8. The mounting assembly of claim 7 in which the support member is generally rectangular in cross section and includes a front wall, a rear wall, and a pair of side walls, the first hook means being attached to the rear wall and the legs of the clamp straddling the side walls, the stud being engageable with the front wall.

9. The mounting assembly of claim 8 in which the second hook means is formed by notches in the legs of the clamp.

10. A mounting assembly adapted for mounting a heater on an LPG tank which includes a top, an outlet valve mounted on the top, and a collar which extends around at least a portion of the outlet valve, the mounting assembly comprising an elongated rigid tube having a rectangular cross section and an upper end for supporting the heater and a lower end, a hook on the lower end of the tube for engaging an edge of a collar on an LPG tank, a generally U-shaped clamp pivotally mounted on the tube adjacent the lower end thereof, the clamp including a pair of legs which straddle the tube and a cross portion which connects the legs, each of the legs terminating in a hooked end for engaging an edge of a collar on an LPG tank, and a stud threadedly engaged with the cross portion of the clamp, the stud being engageable with the support member as the stud is screwed into the cross portion.

11. The mounting assembly of claim 10 in which the rectangular tube includes a front wall, a rear wall, and a pair of side walls, the hook on the lower end of the tube being attached to the rear wall, the legs of the clamps straddling the side walls of the tube, the stud being engageable with the front wall of the tube.

12. The mounting assembly of claim 11 including a bolt which extends through the side walls of the tube and through openings in the legs of the clamp for pivotally mounting the clamp.

13. The mounting assembly of claim 12 in which the openings in the legs are larger than the bolt so that the clamp can move transversely relative to the elongated support member.

* * * * *